US005865150A

United States Patent [19]

Kramer et al.

[11] Patent Number: 5,865,150

[45] Date of Patent: Feb. 2, 1999

[54] DEVICE FOR VARYING THE VALVE TIMING OF GAS EXCHANGE VALVES OF AN INTERNAL COMBUSTION ENGINE

[75] Inventors: Ulrich Kramer, Erlangen; Rainer Venz, Weisendorf; Jens Schafer, Herzogenaurach, all of Germany

[73] Assignee: Ina Walzlager Schaeffler oHG, Germany

[21] Appl. No.: 52,726

[22] Filed: Mar. 31, 1998

[30] Foreign Application Priority Data

Jun. 13, 1997 [DE] Germany ..... 197 25 130.7

[51] Int. Cl.[6] ..... F01L 1/344

[52] U.S. Cl. ..... 123/90.17; 123/90.31; 123/90.37; 277/942

[58] Field of Search ..... 123/90.15, 90.17, 123/90.31, 90.33, 90.34, 90.37; 277/442, 942

[56] References Cited

U.S. PATENT DOCUMENTS

| | | | |
|---|---|---|---|
| 3,020,056 | 2/1962 | Agens | 277/942 |
| 4,744,572 | 5/1988 | Sahba et al. | 277/942 |
| 5,540,197 | 7/1996 | Golovatai-Schmidt et al. | 123/90.17 |
| 5,566,651 | 10/1996 | Strauss et al. | 123/90.17 |
| 5,630,593 | 5/1997 | Swensen et al. | 277/626 |
| 5,727,508 | 3/1998 | Goppelt | 123/90.17 |
| 5,765,517 | 6/1998 | Wiehl | 123/90.17 |

FOREIGN PATENT DOCUMENTS 4218082 12/1993 Germany .

*Primary Examiner*—Weilun Lo

*Attorney, Agent, or Firm*—Bierman, Muserlian and Lucas

[57] ABSTRACT

A device for varying the valve timing of gas exchange valves of an internal combustion engine comprising a driven unit (3) rotationally fixed to a camshaft (2), and a drive unit (6) which is in driving relationship through a traction element with a crankshaft while being rotatably mounted on the driven unit (3), the device (1) further comprising at least two pressure chambers (11, 12) that can be pressurized by a hydraulic pressure medium, the hydraulic pressure medium being fed into the device (1) through a connecting bracket (13) which is rotationally fixed to the driven unit (3) and coaxially surrounds the end portion of the camshaft (2) while comprising on its outer peripheral surface (16), a plurality of annular flanges (29, 30, 31) having sealing rings (20, 21, 22) arranged in annular grooves (17, 18, 19), which annular flanges (29, 30, 31) are sealingly surrounded by a reception bore (36) in a connecting structure (35), characterized in that the sealing rings (20, 21, 22) either comprise an elastic coating (34*a*) at least on an outer peripheral surface (23, 24, 25) and are sealingly force-locked through this coated outer peripheral surface (23, 24, 25) with the reception bore (36) in the connecting structure (35), or the sealing rings (20, 21, 22) comprise a wear-reducing coating (34*b*) at least on an outer peripheral surface (23, 24, 25) and are in a sealed sliding relationship through this coated outer peripheral surface (23, 24, 25) with the reception bore (36) in the connecting structure (35).

4 Claims, 2 Drawing Sheets

DEVICE FOR VARYING THE VALVE TIMING OF GAS EXCHANGE VALVES OF AN INTERNAL COMBUSTION ENGINE

FIELD OF THE INVENTION

A device for varying the valve timing of gas exchange valves of an internal combustion engine comprising a driven unit rotationally fixed to an inlet or exhaust camshaft, and a drive unit which is in driving relationship through a traction element with a crankshaft while being rotatably mounted on the driven unit, the device further comprising two or more pressure chambers which, under alternating or simultaneous pressurizing by a hydraulic pressure medium, effect a rotation and/or a continuous hydraulic clamping of the camshaft relative to the crankshaft, the hydraulic pressure medium being fed into the device through a connecting bracket which is rotationally fixed to the driven unit and coaxially surrounds the end portion of the camshaft while comprising on its outer peripheral surface, a plurality of annular flanges having sealing rings arranged in annular grooves, the hydraulic pressure medium being guided in circumferential annular channels between the annular flanges which are sealingly surrounded by a reception bore in a connecting structure for a control element.

BACKGROUND OF THE INVENTION

In a camshaft adjusting device of the above type known from DE-OS 42 18 082, the required hydraulic pressure medium is fed into the device through a connecting bracket which is rotationally fixed to the driven unit and coaxially surrounds the end portion of the camshaft. The outer peripheral surface of this connecting bracket comprises a number of annular flanges between which the hydraulic pressure medium is guided in circumferential annular channels and which are sealingly surrounded by a reception bore of a connecting plate. The hydraulic medium flows via the control valve and through feed bores made in the connecting plate into the annular channels of the connecting bracket from where it is diverted through a longitudinal channel into a direction perpendicular to the camshaft adjusting direction. The sealing of the pressure medium conveying channels is achieved by steel sealing rings comprising a split gap and arranged in annular grooves in the outer peripheral surface of the annular flanges of the connecting bracket while bearing sealingly against the inner wall of the reception bore of the connecting plate.

Practice has shown, however, that in such sealing arrangements, the rotation of the driven unit is transmitted to the steel sealing rings which causes them to "dig" into the inner wall of the reception bore with their radial bearing surfaces, or the steel sealing rings and the reception bore undergo a considerable amount of wear. This detrimental behavior is due to frictional locking between the steel sealing rings and the inner wall of the reception bore resulting from the pressure of the hydraulic pressure medium prevailing in the annular channels and, more importantly, from the radial pre-stress of the steel sealing rings.

Measurements of the pre-stress of "dug-in" steel sealing rings have shown that the steel sealing rings can get buried to the extent that the pre-stress force becomes zero. This can result, for example, in a setting-free of scuffing chips which, on penetrating into the camshaft adjusting device, can cause a malfunctioning. Further, the "digging-in" of the steel sealing rings into the reception bore causes a radial expansion of the steel sealing rings which results in an enlargement of the split gap of the steel sealing rings arranged in the annular grooves and thus also in an enlargement of the leak gap of the steel sealing rings. Under certain circumstances, this can lead to a loss of pressure medium in the pressure chambers of the camshaft adjusting device during a standstill of the internal combustion engine, so that the adjusting piston is no longer sufficiently clamped hydraulically during starting of the engine and can abut unobstructedly against its end stops resulting in a disadvantageous generation of noise.

It was also determined that from a certain penetration depth of the steel sealing rings into the reception bore during operation of the engine especially at low engine speeds, vital system characteristic values such as, for example, the adjusting speed of the camshaft adjusting device, are strongly reduced because the additional pressure medium leakages and a limited performance of the pressure medium pump lead to a sinking of the pressure level. Even the use of steel sealing rings with a lower pre-stress force has not been able to substantially diminish the "digging-in" effect of the steel sealing rings because the attainable minimum pre-stress force is determined essentially by the toleranced inner diameter of the steel sealing rings, and the surface pressure of the steel sealing rings, especially in the presence of pressure medium pressure is, in any case, still so high that the aforesaid "digging-in" with its negative consequences continues to occur.

OBJECTS OF THE INVENTION

It is an object of the invention to provide a device for varying the valve timing of gas exchange valves of an internal combustion engine in which, with the use of simple means, the "digging-in" of the sealing rings into the inner wall of a reception bore is avoided, and in which, by an improved sealing between the rotating connecting bracket and a stationary connecting structure, the aforesaid pressure medium leakages are reduced to a minimum.

This and other objects and advantages of the invention will become obvious from the following detailed description.

SUMMARY OF THE INVENTION

The device of the invention for varying valve timing of gas exchange valves of an internal combustion engine comprising a driven unit (3) rotationally fixed to an inlet or exhaust camshaft (2), and a drive unit (6) which is in driving relationship through a traction element with a crankshaft while being rotatably mounted on the driven unit (3), the device (1) further comprising at least two pressure chambers (11, 12) which, under alternating or simultaneous pressurizing by a hydraulic pressure medium, effect a rotation and/or a continuous hydraulic clamping of the camshaft (2) relative to the crankshaft, the hydraulic pressure medium being fed into the device (1) through a connecting bracket (15) which is rotationally fixed to the driven unit (3) and coaxially surrounds an end portion of the camshaft (2) while comprising on an outer peripheral surface (16), a plurality of annular flanges (29, 30, 31) having sealing rings (20, 21, 22) arranged in annular grooves (17, 18, 19), the hydraulic pressure medium being guided in circumferential annular channels (32, 33) between the annular flanges (29, 30, 31) which are sealingly surrounded by a reception bore (36) in a connecting structure (35) for a control element (37) is characterized in that, the sealing rings (20, 21, 22) which are configured to have a low or no pre-stress during standstill of the internal combustion engine comprise an elastic coating **(34*a*) at least on an outer peripheral surface (23, 24, 25), and, due to the pressure of the hydraulic pressure medium, the sealing rings (20, 21, 22) are sealingly force-locked through their coated outer peripheral surface (23, 24, 25) with the reception bore (36) in the stationary connecting structure (35) through the entire operating range of the internal combustion engine while being in a sealed sliding relationship by one of their side faces (26, 27, 28) with the annular grooves (17, 18, 19) in the rotating connecting bracket (15**).

The sealing rings which are configured to have a low or no pre-stress during standstill of the internal combustion engine comprise an elastic coating at least on their outer peripheral surfaces, and, due to the pressure of the hydraulic pressure medium, the sealing rings are sealingly force-locked through their coated outer peripheral surface with the reception bore in the stationary connecting structure through the entire operating range of the internal combustion engine while being in a sealed sliding relationship by one of their side faces with their annular grooves in the rotating connecting bracket.

In a second, alternative embodiment of the invention, the sealing rings comprise a wear-reducing coating at least on their outer peripheral surfaces and/or the reception bore in the connecting structure cooperating with the sealing rings comprises, at least on some parts, a wear-reducing coating, the sealing rings being in a sealed sliding relationship both with the reception bore in the connecting structure and, by one of their side faces, with their annular grooves.

Thus, compared to prior art devices, the camshaft adjusting device of the invention has the advantage that the detrimental "digging-in" of the sealing rings into the reception bore of a connecting structure and the resulting leakages in the connecting region of the device as well as the other drawbacks of the prior art discussed above are effectively avoided. A particular advantage of the first embodiment of the invention is that this effect is achieved with sealing rings that remain stationary during the operation of the engine. A further advantage of the device of this embodiment is that the sealing rings can be made relatively simply and in spite of this, with extremely exact dimensions because relatively roughly machined base steel sealing rings can be used and further finishing steps such as vibratory grinding and light-tightness tests can be omitted.

Other advantages worth mentioning are the long working life of such sealing rings and their excellent sealing characteristics which are not prejudiced even by an excessive sealing force exerted by the hydraulic pressure medium because the wear occurring thereby in the coating leads to an adaptation of the sealing rings which lowers the sealing force to an uncritical value near to 0 without restricting the functions of the system.

In a device made in accordance to the alternative embodiment of the invention, the "digging-in" of the sealing rings is avoided even with the sealing rings rotating as usual during operation of the engine, the extremely simple manufacturing with exact dimensions being, in this case too, a particular advantage.

According to a further feature of the first embodiment of the invention, the sealing rings are preferably steel sealing rings with a reduced diameter and a rectangular profile cross-section, are tempered in an unwidened state and are coated on their outer peripheral surface with a thermoplastic or an elastomer which can be compressed against the reception bore in the connecting structure. The reduction of diameter refers to the use of standard commercial sealing rings and depends on the thickness of the coating to be applied. The tempering of the steel sealing rings in the unwidened state, in contrast, is intended to minimize the internal stresses of the sealing rings which have hitherto been the main cause of the "digging-in" of the sealing rings. Sealing rings with a rectangular profile cross-section have proved to be the most advantageous for simplifying the coating procedure. It is understood, however, that it is also possible to use sealing rings with other profile cross-sections, for example, square, round, oval or other similar shapes.

Similarly, thermoplastics or elastomers have proved to be the most suitable coating materials for permitting a compression of the coating against the reception bore in the connecting structure by the pressure of the hydraulic pressure medium. Advantageously, the coating should be applied across the entire ring thickness and form a smooth peripheral surface to obtain the largest possible friction surface on the sealing rings which is required for establishing a force-locking with the reception bore. A partial coating of the outer peripheral surface of the sealing rings and/or other coating cross-sections are, however, also feasible and are likewise included in the scope of the invention.

According to a further feature of this embodiment, the coating has a Shore A hardness of 80 and a thickness of 0.05 mm to 0.1 mm because, with this combination, a sealing force of >0N to 1.5N can be obtained in the case of sealing rings having no pre-stress. This tolerance range enables the obtention of an optimum in sealing capacity, wear and working life of the sealing rings which guarantees a high operational reliability of the camshaft adjusting device. In the case of pre-stressed sealing rings, a sealing force of up to 10N can be reached.

According to a further feature of the alternative embodiment of the invention, the wear-reducing coating is preferably applied only to the outer peripheral surface of the sealing rings, and the sealing rings are also preferably steel sealing rings with a reduced diameter and a rectangular profile cross-section. In this case too, this solution has proved to be the most economic for the coating procedure and adequate with regard to improved sealing properties of the sealing rings. The diameter reduction of the sealing rings refers, in this case too, to the use of standard commercial sealing rings and depends on the thickness of the coating to be applied which, again, is advantageously applied across the entire ring thickness and forms a smooth outer peripheral surface. However, it is also conceivable to apply a wear-reducing coating both on the outer peripheral surface of the sealing rings and on the reception bore in the connecting structure, or even only on the reception bore or only on the annular surfaces of the reception bore cooperating with the sealing rings, and/or to use sealing rings with other profile cross-sections. If the connecting structure is made, for example, of aluminium, the wear-reducing coating of the reception bore or of the annular surfaces of the reception bore cooperating with the sealing rings may be replaced by a wear-reducing surface treatment such as electrolytic oxidation or even anodizing.

Finally, according to a further feature of the alternative embodiment of the invention, the wear-reducing coating is made preferably of a softer material than the sealing rings and is preferably a coating of bright silver with a thickness of 0.004 to 0.01 mm. Such a coating guarantees that the coating does not break off under the high load of the rotating sealing rings at the sealing rings adapt themselves to the reception bore by the abrasion of the coating on the reception bore and thus seal the annular channels in the connecting bracket leak-free from one another. The proposed coating thickness is optimal for a bright silver coating but in the case of other feasible coating materials such as copper, silver, polytetrafluorethylene (teflon), chromium, tin, zinc, molybdenum, gold, lead, cadmium or their alloys, it can be larger or smaller.

BRIEF DESCRIPTION OF THE DRAWINGS

The invention will now be described with reference to the appended drawings.

DETAILED DESCRIPTION OF THE INVENTION

Figure 1:
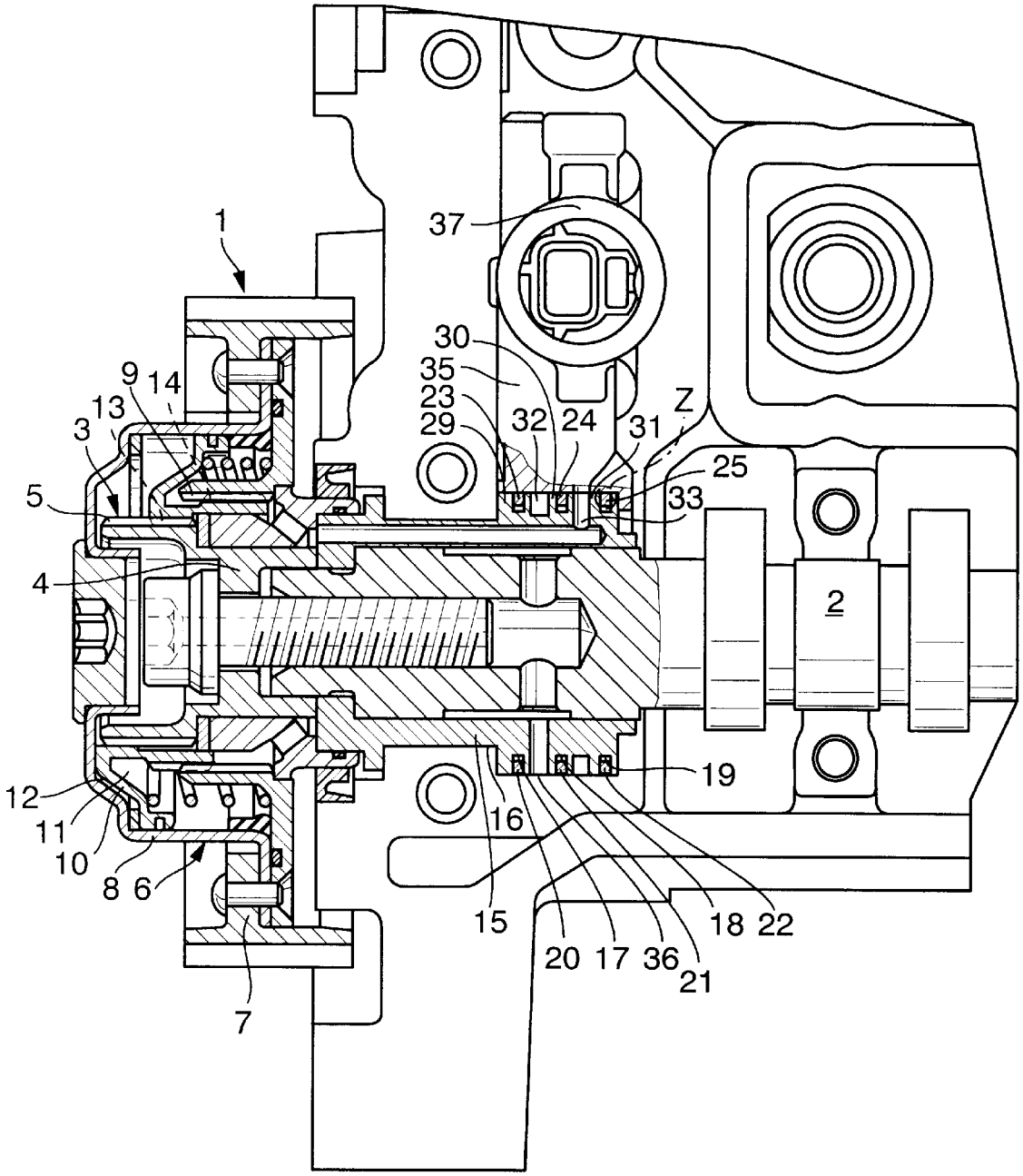
FIG. 1 is a longitudinal cross-section through a device for varying valve timing comprising a connecting bracket and being fixed on a camshaft in a cylinder head of an internal combustion engine.

FIG. 1 shows a device 1 of a known type for a continuous variation of the angular position of a camshaft 2 relative to a crankshaft, not shown. This device 1 comprises a driven unit 3 which is rotationally fixed to the camshaft 2 and constituted by a hub 4 having a helical gearing 5. The device 1 also comprises a drive unit 6 mounted for rotation on the driven unit 3 and constituted by a drive pinion 7 having a housing 8 rotationally fixed thereto, and a further helical gearing 9, the drive unit 6 being in driving relationship with the crankshaft through a traction element. The device 1 further comprises an adjusting piston 10 which is axially displaceable within the housing 8 by a hydraulic pressure medium, said adjusting piston 10 axially delimiting two pressure chambers 11, 12 which can be connected alternately or simultaneously to a pressure medium feed duct and a pressure medium discharge duct. The adjusting piston 10 comprises a first helical gear section 13 which cooperates with the complementary helical gearing 5 of the driven unit 3 and, axially spaced from the first gear section 13, a second, axially spaced and oppositely oriented gear section 14 which cooperates with the complementary gearing 9 of the drive unit 6.

FIG. 1 further shows that the hydraulic medium is supplied to the device 1 in a known manner through a connecting bracket 15 which is rotationally fixed to the driven unit 3 and arranged coaxially around the end portion of the camshaft 2 while comprising a number of annular flanges 29, 30, 31 on its outer peripheral surface 16. Each of these annular flanges 29, 30, 31 is made with an annular groove 17, 18, 19 into which is inserted a sealing ring 20, 21, 22. The hydraulic medium is conveyed through two circumferentially extending annular channels 32 and 33 formed between the annular flanges 29, 30, 31. The annular channels 32, 33 are connected by axial bores, not specified, of the connecting bracket 15 and through further pressure medium channels with the pressure chambers 11, 12 of the device 1. The annular flanges 29, 30, 31 are surrounded by a reception bore 36 of a connecting structure 35 that also serves for lodging a control element 37 which regulates the required pressure medium supply and discharge via the engine management.

Figure 2:
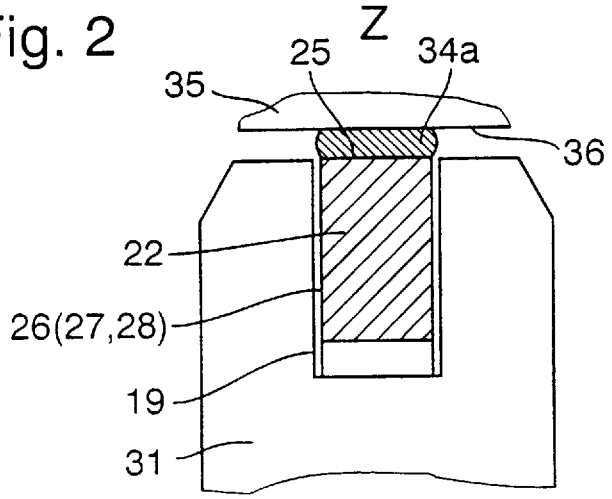
FIG. 2 is an enlarged representation of the detail Z of FIG. 1 showing a first embodiment of the invention.

The enlarged representation of FIG. 2 further shows that the sealing rings 20, 21, 22 of the invention which have no or little pre-stress during the stillstand of the internal combustion engine comprise an elastic coating 34*a* on their outer peripheral surfaces 23, 24, 25. Due to the pressure of the hydraulic pressure medium, the sealing rings 20, 21, 22 are sealingly force-locked through their coating 34*a* with the reception bore 36 in the stationary connecting structure 35 through the entire operational range of the internal combustion engine while being in sealed sliding relationship by their side surfaces 26, 27, 28 with their annular grooves 17, 18, 19 in the rotating connecting bracket 15. The sealing rings are steel sealing rings tempered in an unwidened state and having a rectangular profile cross-section and a slightly reduced diameter.

The sealing rings are coated, as shown by way of example in the case of the sealing ring 22 in FIG. 2, on the outer peripheral surface 25 with an elastomer which is compressible against the reception bore 36 in the connecting structure 35. If an elastomer with a Shore A hardness of 80 is chosen for the coating and applied with a thickness of 0.05 mm to 0.1 mm to the steel sealing ring, the sealing force of >0N to 1.5N which can be obtained therewith in the sealing rings 20, 21, 22 which are free of pre-stress is sufficient to hold the sealing rings 20, 21, 22 against the reception bore 36 and thus avoid a rotation of the sealing rings 20, 21, 22 with the connecting bracket 15, which rotation would cause a "digging-in" of the sealing rings 20, 21, 22.

Figure 3:
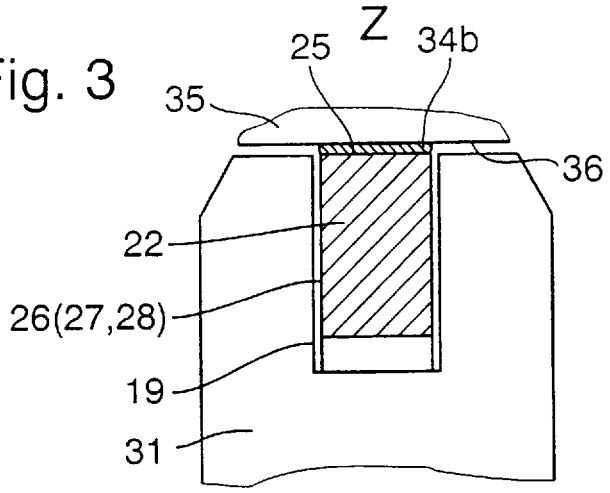
FIG. 3 is an enlarged representation of the detail Z of FIG. 1 showing an alternative embodiment of the invention.

FIG. 3 shows one example of the alternative embodiment of the invention in which the sealing rings 20, 21, 22 comprise a wear-reducing coating 34*b* at least on their outer peripheral surface 23, 24, 25 and/or the reception bore 36 in the connecting structure 35 cooperating with the sealing rings 20, 21, 22 comprises, at least on some parts, a wear-reducing coating, and the sealing rings 20, 21, 22 are in a sealed sliding relationship both with the reception bore 36 in the connecting structure 35 and, by one of their side faces, with their annular grooves 17, 18, 19. In the example of FIG. 3, the wear-reducing coating 34*b* is applied only to the outer peripheral surfaces 26, 27, 28 of the sealing rings 20, 21, 22 which are steel sealing rings with a reduced diameter and a rectangular profile cross-section. The wear-reducing coating 34*b* is made of a softer material than the sealing rings 20, 21, 22 which, in the present case, is a bright silver coating with a thickness of 0.004 mm to 0.01 mm. This wear-reducing coating 34*b* reduces the friction force of the sealing rings 20, 21, 22 in the reception bore 36 resulting from their pre-stress and thus prevents a "digging-in" of the sealing rings 20, 21, 22 into the reception bore 36 despite a rotation of the sealing rings 20, 21, 22 with the connecting bracket 15.

Various modifications of the device of the invention may be made without departing from the spirit or scope thereof and it is to be understood that the invention is intended to be limited only as defined in the appended claims.

What we claim is:

1. A device for varying valve timing of gas exchange valves of an internal combustion engine comprising a driven unit (3) rotationally fixed to at least one of an inlet and exhaust camshaft (2), and a drive unit (6) which is in driving relationship through a traction element with a crankshaft while being rotatably mounted on the driven unit (3), the device (1) further comprising at least two pressure chambers (11, 12) which, under at least one of alternating and simultaneous pressurizing by a hydraulic pressure medium, effect at least one of a rotation and a continuous hydraulic clamping of the camshaft (2) respectively relative to the crankshaft, the hydraulic pressure medium being red into the device (1) through a connecting bracket (15) which is rotationally fixed to the driven unit (3) and coaxially surrounds an end portion of the camshaft (2) while comprising on an outer peripheral surface (16), a plurality of annular flanges (29, 30, 31) having sealing rings (20, 21, 22) arranged in annular grooves (17, 18, 19), the hydraulic pressure medium being guided in circumferential annular channels (32, 33) between the annular flanges (29, 30, 31) which are sealingly surrounded by a reception bore (36) in a connecting structure (35) for a control element (37) characterized in that, at least one of: the sealing rings (20, 21, 22) comprise a wear-reducing coating (34*b*) on at least an outer peripheral surface (23, 24, 25); and the reception bore (36) of the connecting structure (35) cooperating with the sealing rings (20, 21, 22) comprises, at least on some portions of the reception bore, a wear-reducing coating (34*b*), the sealing rings (20, 21, 22) being in a sealed sliding relationship both with the reception bore (36) in the connecting structure (35) and, by their side surfaces (26, 27, 28), with the annular grooves (17, 18, 19).

2. A device of claim 1 wherein the wear-reducing coating (34*b*) is applied only to the outer peripheral surface (23, 254, 25) of the sealing rings (20, 21, 22), and the sealing rings (20, 21, 22) have a reduced diameter and a rectangular profile cross-section.

3. A device of claim 1 wherein the wear-reducing coating (34*b*) is made of a softer material than the sealing rings (20, 21, 22) and is a coating of bright silver with a thickness of 0.004 to 0.01 mm.

4. A device of claim 2 wherein the wear-reducing coating (34*b*) is made of a softer material than the sealing rings (20, 21, 22) and is a coating of bright silver with a thickness of 0.004 to 0.01 mm.

* * * * *